US009151176B2

(12) United States Patent
Chillar et al.

(10) Patent No.: US 9,151,176 B2
(45) **Date of Patent: *Oct. 6, 2015**

(54) SYSTEMS AND METHODS FOR ADJUSTING CLEARANCES IN TURBINES

(75) Inventors: Rahul J. Chillar, Atlanta, GA (US); Adil Ansari, Atlanta, GA (US); Ezio Pena, Belfort (FR); Nicolas Antoine, Belfort (FR); Jean-louis Vignolo, Belfort (FR)

(73) Assignee: General Electric Company, Schenectady, NY (US)

( * ) Notice: Subject to any disclaimer, the term of this patent is extended or adjusted under 35 U.S.C. 154(b) by 656 days.

This patent is subject to a terminal disclaimer.

(21) Appl. No.: 13/473,095

(22) Filed: May 16, 2012

(65) Prior Publication Data

US 2013/0129484 A1 May 23, 2013

Related U.S. Application Data

(63) Continuation-in-part of application No. 13/302,372, filed on Nov. 22, 2011.

(51) Int. Cl.
*F01D 11/24* (2006.01)

(52) U.S. Cl.
CPC ..... *F01D 11/24* (2013.01); *Y10T 29/49238* (2015.01)

(58) Field of Classification Search
CPC ..... F01D 11/24; F01D 11/20; F01D 11/14; F16M 1/04
USPC ..... 415/1, 14, 47, 108, 114, 118, 134, 136, 415/173.1, 173.2, 177, 178, 196, 197, 217.1
See application file for complete search history.

(56) References Cited

U.S. PATENT DOCUMENTS 8,152,446 B2 * 4/2012 Zhang et al. ..... 415/108
2008/0006983 A1 1/2008 Chung et al.

FOREIGN PATENT DOCUMENTS

DE 102006012977 10/2007
DE 102006012977 A1 10/2007

(Continued)

OTHER PUBLICATIONS

EP Search Report and Written Opinion issued Mar. 25, 2014 in connection with corresponding EP Patent Application No. 13167183.6.

(Continued)

*Primary Examiner* — Edward Look
*Assistant Examiner* — Juan G Flores
(74) *Attorney, Agent, or Firm* — Sutherland Asbill & Brennan LLP

(57) ABSTRACT

Embodiments of the invention can provide systems and methods for adjusting clearances in a turbine. According to one embodiment, there is disclosed a turbine system. The system may include one or more turbine blades, a turbine casing encompassing the one or more turbine blades, a thermoelectric element disposed at least partially about the turbine casing, a cooling system in communication with the thermoelectric element, and a controller in communication with the cooling system and the thermoelectric element. The controller may be operable to control the expansion or contraction of the turbine casing by heating or cooling at least a portion of the turbine casing with the thermoelectric element and by adjusting the cooling system such that a clearance between the one or more turbine blades and the turbine casing is adjusted.

20 Claims, 5 Drawing Sheets

(56) References Cited

FOREIGN PATENT DOCUMENTS

| | | | | |
|---|---|---|---|---|
| EP | 2372105 | A2 | 10/2011 | |
| EP | 2597268 | A2 | 5/2013 | |
| FR | EP-1777373 | A1 * | 4/2007 | ..... F01D 11/24 |
| FR | 2943717 | A1 | 10/2010 | |
| GB | 2103718 | A | 2/1983 | |
| JP | 2000286463 | | 10/2000 | |
| JP | 2007-77990 | A | 3/2007 | |
| WO | 2007032803 | | 3/2007 | |
| WO | 2011/030051 | A1 | 3/2011 | |

OTHER PUBLICATIONS

Chinese Office Action dated Jul. 30, 2015 for Application No. CN 201310181219.1.

* cited by examiner

SYSTEMS AND METHODS FOR ADJUSTING CLEARANCES IN TURBINES

CROSS-REFERENCE TO RELATED APPLICATIONS

The present application is a continuation-in-part of and claims the benefit of U.S. patent application Ser. No. 13/302,372, filed Nov. 22, 2011, issued as U.S. Pat. No. 9,057,282, which is hereby incorporated by reference in its entirety.

FIELD OF THE DISCLOSURE

Embodiments of the present application relate generally to turbines, and more particularly to systems and methods for adjusting clearances in turbines.

BACKGROUND OF THE DISCLOSURE

Turbine blades and turbine casings may expand or contract during startup and operation of a turbine due to the thermal state of the turbine. Accordingly, a clearance between the turbine blades and the turbine casing may vary due to the expansion and contraction of the turbine blades and turbine casing. Generally, the smaller the clearance between the turbine blades and the turbine casing, the greater the efficiency of the turbine during operation. Moreover, the larger the clearance between the turbine blades and the turbine casing, the faster the startup of the turbine.

BRIEF DESCRIPTION OF THE DISCLOSURE

Some or all of the above needs and/or problems may be addressed by certain embodiments of the present application. Disclosed embodiments may include systems and methods for adjusting clearances in turbines. According to one embodiment, there is disclosed a turbine system. The system may include one or more turbine blades, a turbine casing encompassing the one or more turbine blades, a thermoelectric element disposed at least partially about the turbine casing, a cooling system in communication with the thermoelectric element, and a controller in communication with the cooling system and the thermoelectric element. The controller may be operable to control the expansion or contraction of the turbine casing by heating or cooling at least a portion of the turbine casing with the thermoelectric element and by adjusting the cooling system such that a clearance between the one or more turbine blades and the turbine casing is adjusted.

According to another embodiment of the present application, there is disclosed a method for adjusting clearances in a turbine. The turbine may include a turbine casing encompassing one or more turbine blades. The method may include positioning one or more thermoelectric elements at least partially about the turbine casing, providing a cooling system in communication with the one or more thermoelectric elements, controlling a voltage to the one or more thermoelectric elements, and controlling a fluid flow of the cooling system.

Further, according to another embodiment of the present application, there is disclosed another turbine system. The system may include one or more turbine blades, a turbine casing encompassing the one or more turbine blades, at least one thermoelectric element disposed at least partially about the turbine casing, a cooling system in communication with the thermoelectric element, and a controller in communication with the cooling system and the at least one thermoelectric element. The controller may include a computer processor and a memory in communication with the computer processor operable to store computer-executable instructions operable to control the expansion or contraction of the turbine casing by heating or cooling at least a portion of the turbine casing with the thermoelectric element and by adjusting the cooling system such that a clearance between the one or more turbine blades and the turbine casing is adjusted.

Other embodiments, aspects, and features of the present application will become apparent to those skilled in the art from the following detailed description, the accompanying drawings, and the appended claims.

BRIEF DESCRIPTION OF THE DRAWINGS

Reference will now be made to the accompanying drawings, which are not necessarily drawn to scale, and wherein.

DETAILED DESCRIPTION OF THE DISCLOSURE

Illustrative embodiments of the present application will now be described more fully hereinafter with reference to the accompanying drawings, in which some, but not all embodiments of the present application are shown. The present application may be embodied in many different forms and should not be construed as limited to the embodiments set forth herein; rather, these embodiments are provided so that this disclosure will satisfy applicable legal requirements. Like numbers refer to like elements throughout.

Illustrative embodiments are directed to, among other things, systems and methods for adjusting clearances in a turbine. Certain illustrative embodiments may be directed to a thermoelectric element disposed about at least a portion of a turbine casing for expanding or contracting the turbine casing by heating or cooling at least a portion of the turbine casing thereby adjusting a clearance between one or more turbine blades and the turbine casing.

In some embodiments, the thermoelectric element may include a Peltier element disposed between a cold sink and a heat sink. A voltage may be applied to the Peltier element to control heat transfer between the cold sink and the heat sink. The cold sink and the heat sink may be dependent on the polarity of the applied voltage to the Peltier element. In some aspects, the cold sink and the heat sink may include ceramic plates. In other aspects, the heat sink may be in communication with a cooling system. In still other aspects, the thermoelectric element may be disposed circumferentially about at least a portion of the turbine casing in line with the one or more turbine blades.

Certain embodiments can provide a technical solution to adjusting clearances between one or more turbine blades and the turbine casing. In one embodiment, the clearance between the one or more turbine blades and the turbine casing may be reduced to increase efficiency during operation. In this manner, the turbine casing may be cooled to contract it about the one or more turbine blades. In another embodiment, the clearance between the one or more turbine blades and the turbine casing may be increased to increase efficiency during startup and increase the speed of the startup. In this manner, the turbine casing may be heated to expand it about the one or more turbine blades to allow the one or more turbine blades to expand during startup. In yet another embodiment, the clearance between the one or more turbine blades and the turbine casing may be adjusted to increase efficiency during transitions.

Figure 1:
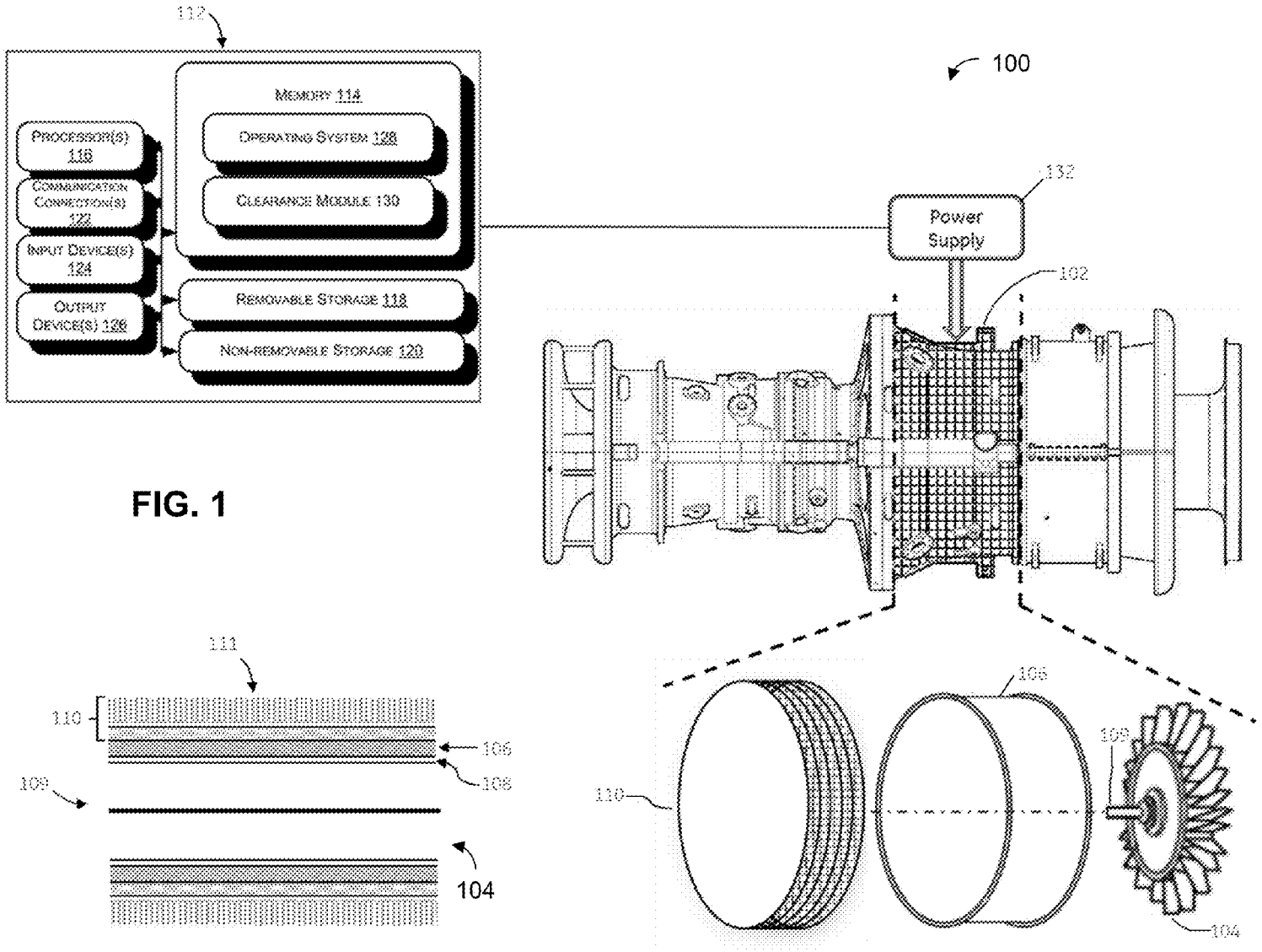
FIG. 1 is a schematic illustrating an example turbine system including a block diagram of a computer environment for adjusting clearances in the turbine, according to an embodiment.

FIG. 1 provides an example turbine system 100 illustrating details for adjusting clearances in a turbine 102. The turbine 102 may include one or more turbine blades 104 (or rotors). The turbine 102 may also include a turbine casing 106 (or stator) such that the turbine casing 106 encompasses the one or more turbine blades 104. The one or more turbine blades 104 generally rotate about a center axis 109 of the turbine 102. The turbine 102 may include a clearance 108 between the distal ends of the one or more turbine blades 104 and the inner radius of the turbine casing 106.

The turbine system 100 may include a thermoelectric element 110 disposed at least partially about the turbine casing 106. In certain embodiments, the thermoelectric element 110 may be disposed at least partially about the turbine casing in line within the turbine blades 104. The thermoelectric element 110 may heat or cool a portion of the turbine casing 106 in communication with the thermoelectric element 110. The heating and cooling of the turbine casing 106 by the thermoelectric element 110 may expand or contract at least a portion of the turbine casing 106, respectively. The expansion and contraction of the turbine casing 106 adjusts the clearance 108 between the one or more turbine blades 104 and the turbine casing 106. One or more thermal sensors may be disposed on or about the turbine casing, the one or more turbine blades, and/or any other location on or about the turbine to monitor the turbine system 100.

In certain embodiments, the thermoelectric element 110 may include a heat sink 111 for dissipating heat from the thermoelectric element 110. The heating or cooling of the one or more thermoelectric elements 110 is dependent on a voltage and polarity received from a power source 132. For example, the heat sink 111 may be a heat sink or a cold sink depending on the polarity of the power source received by the thermoelectric element 110. Accordingly, whether the thermoelectric element is in a heating mode or a cooling mode is dependent on the polarity of the power source 132.

Still referring to FIG. 1, in certain illustrative embodiments, the turbine system 100 may include a controller device 112 for adjusting the clearance between the one or more turbine blades 104 and the turbine casing 106. The controller device 112 may be configured as any suitable computing device capable of implementing the disclosed features, and accompanying methods, such as, but not limited to, those described with reference to FIG. 4. By way of example and not limitation, suitable computing devices may include personal computers (PCs), servers, server farms, data centers, or any other device capable of storing and executing all or part of the disclosed features.

In one illustrative configuration, the controller device 112 includes at least a memory 114 and one or more processing units (or processor(s)) 116. The processor(s) 116 may be implemented as appropriate in hardware, software, firmware, or combinations thereof. Software or firmware implementations of the processor(s) 116 may include computer-executable or machine-executable instructions written in any suitable programming language to perform the various functions described.

Memory 114 may store program instructions that are loadable and executable on the processor(s) 116, as well as data generated during the execution of these programs. Depending on the configuration and type of controller device 112, memory 114 may be volatile (such as random access memory (RAM)) and/or non-volatile (such as read-only memory (ROM), flash memory, etc.). The computing device or server may also include additional removable storage 118 and/or non-removable storage 120 including, but not limited to, magnetic storage, optical disks, and/or tape storage. The disk drives and their associated computer-readable media may provide non-volatile storage of computer-readable instructions, data structures, program modules, and other data for the computing devices. In some implementations, the memory 114 may include multiple different types of memory, such as static random access memory (SRAM), dynamic random access memory (DRAM), or ROM.

Memory 114, removable storage 118, and non-removable storage 120 are all examples of computer-readable storage media. For example, computer-readable storage media may include volatile and non-volatile, removable and non-removable media implemented in any method or technology for storage of information such as computer-readable instructions, data structures, program modules or other data. Memory 114, removable storage 118, and non-removable storage 120 are all examples of computer storage media. Additional types of computer storage media that may be present include, but are not limited to, programmable random access memory (PRAM), SRAM, DRAM, RAM, ROM, electrically erasable programmable read-only memory (EEPROM), flash memory or other memory technology, compact disc read-only memory (CD-ROM), digital versatile discs (DVD) or other optical storage, magnetic cassettes, magnetic tape, magnetic disk storage or other magnetic storage devices, or any other medium which can be used to store the desired information and which can be accessed by the server or other computing device. Combinations of any of above should also be included within the scope of computer-readable media.

Alternatively, computer-readable communication media may include computer-readable instructions, program modules, or other data transmitted within a data signal, such as a carrier wave, or other transmission.

The controller device 112 may also contain communication connection(s) 122 that allow the controller device 112 to communicate with a stored database, another computing device or server, user terminals, and/or other devices on a network. The controller device 112 may also include input device(s) 124, such as a keyboard, mouse, pen, voice input device, touch input device, etc., and output device(s) 126, such as a display, speakers, printer, etc.

Turning to the contents of the memory 114 in more detail, the memory 114 may include an operating system 128 and one or more application programs or services for implementing the features disclosed herein including a clearance module 130. The clearance module 130 may be configured to control the expansion or contraction of the turbine casing 106 by controlling the heating or cooling of at least a portion of the turbine casing 106 via the one or more thermoelectric elements 110 such that the clearance 108 between the one or more turbine blades 104 and the turbine casing 106 is adjusted due to the expansion or contraction of the turbine casing 106. The clearance module 130 can control the heating or cooling of the one or more thermoelectric elements 110 by controlling the voltage and polarity received by the one or more thermoelectric elements 110 from the power source 132. That is, the heating or cooling of the thermoelectric element 110 is dependent on the polarity of the voltage it receives from the power source 132. In certain embodiments, as power from the power source 132 is increased, the heating or cooling of the turbine casing 106 may increase. Conversely, in other embodiments, as power from the power source 132 is decreased, the heating or cooling of the turbine casing 106 may decrease.

Various instructions, methods and techniques described herein may be considered in the general context of computer-executable instructions, such as program modules, executed by one or more computers or other devices. Generally, program modules include routines, programs, objects, components, data structures, etc., for performing particular tasks or implementing particular abstract data types. These program modules and the like may be executed as native code or may be downloaded and executed, such as in a virtual machine or other just-in-time compilation execution environment. Typically, the functionality of the program modules may be combined or distributed as desired in various embodiments. An implementation of these modules and techniques may be stored on some form of computer-readable storage media.

The example controller device 112 shown in FIG. 1 is provided by way of example only. Numerous other operating environments, system architectures, and device configurations are possible. Accordingly, embodiments of the present disclosure should not be construed as being limited to any particular operating environment, system architecture, or device configuration.

Figure 2:
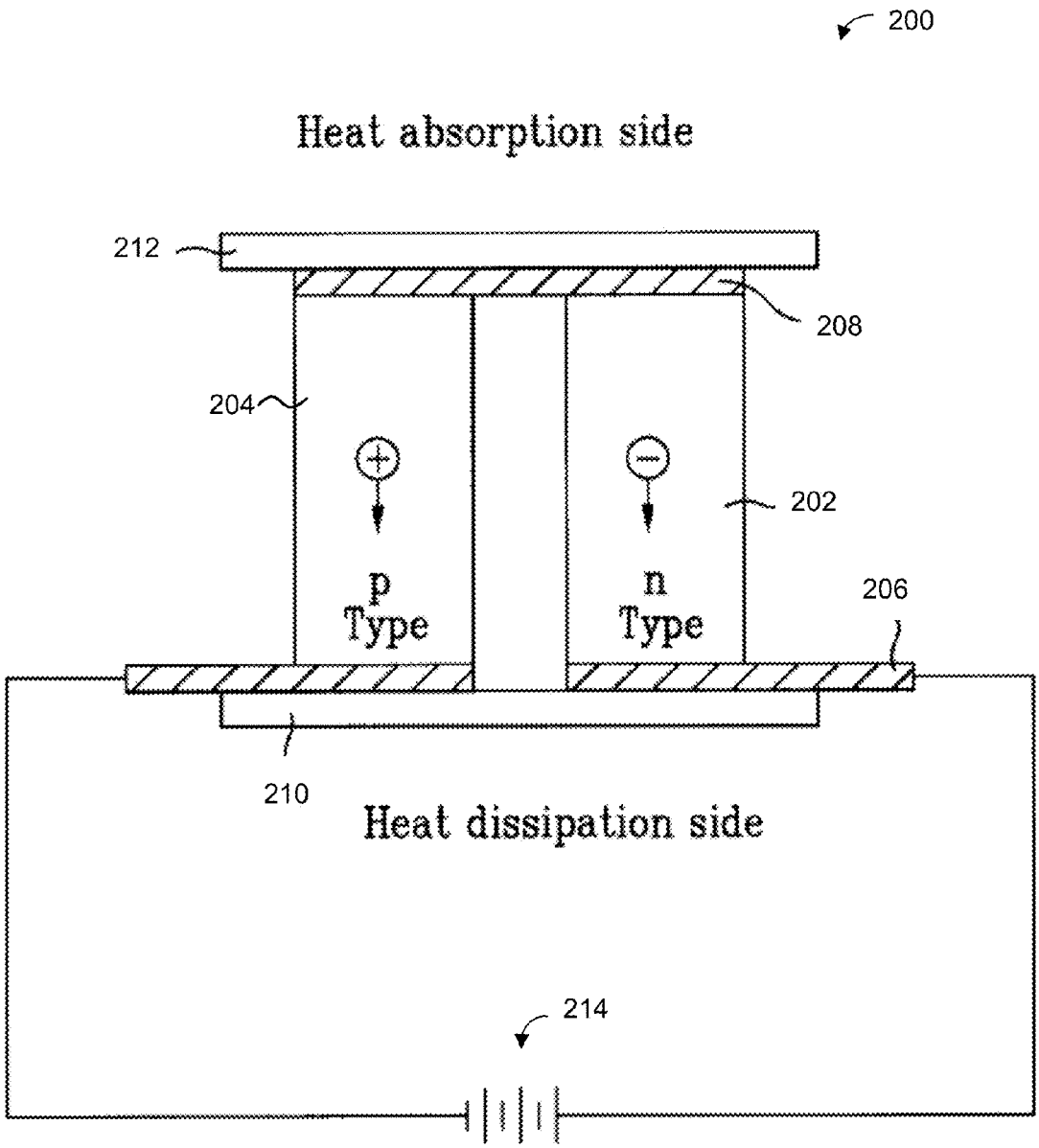
FIG. 2 is a schematic illustrating details of an example thermoelectric element, according to an embodiment.

FIG. 2 is a schematic illustrating details of an example thermoelectric element 200. In certain embodiments, the thermoelectric element 200 may include at least one Peltier element or may include a component employing or otherwise implementing the Peltier effect. For example, the thermoelectric element 200 may include a semiconductor 202 doped with N-type impurity ions and a semiconductor 204 doped with P-type impurity ions. The N-type and P-type doped semiconductor elements 202 and 204 may be connected together by conductors 206 and 208 to form a serial electronic circuit and a parallel thermal circuit. Heat transfer substrates 210 and 212 may enclose the conductors 206 and 208, respectively. The heat transfer substrates 210 and 212 may be cold sinks or heat sinks depending on the polarity of the thermoelectric element 200.

As is known in Peltier-type thermoelectric elements, the application of a current 214 to the thermoelectric element 200 facilitates localized heating and/or cooling in the junctions and/or conductors as the energy difference in the Peltier-type thermoelectric element becomes converted to heat or cold. Accordingly, the thermoelectric element 200 can be arranged such that heating occurs in one location and cooling in another and vice versa.

The heat transfer substrates 210 and 212 may be a cold sink or heat sink depending on the polarity of the voltage applied to the thermoelectric element 200. For example, as depicted in FIG. 2, the heat transfer substrate 212 is a cold sink, and the heat transfer substrate 210 is a heat sink. In other embodiments, the heat transfer substrate 212 may be a heat sink, and the heat transfer substrate 210 may be a cold sink.

Figure 3:
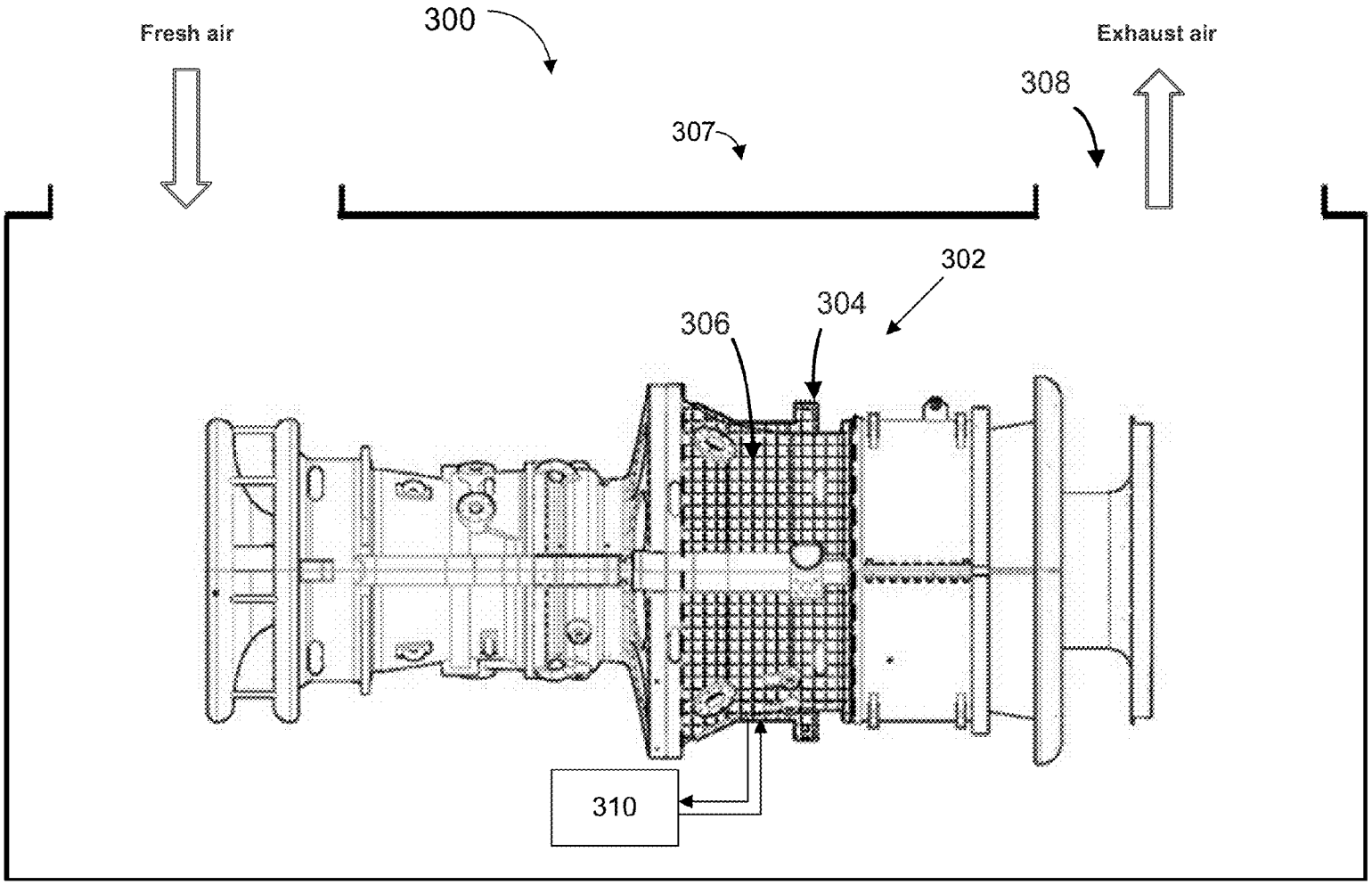
FIG. 3 is a schematic illustrating an example turbine system, according to an embodiment.

FIG. 3 is a schematic illustrating an example turbine system 300. The turbine system 300 may include a turbine 302. The turbine 302 may include a turbine casing 304. The turbine system 300 may also include a thermoelectric element 306 disposed at least partially about the turbine casing 304. The thermoelectric element 306 heats or cools a portion of the turbine casing 304 in communication with the thermoelectric element 306. The heating and cooling of the turbine casing 304 by the thermoelectric element 306 expands or contracts at least a portion of the turbine casing 304, respectively. The expansion and contraction of the turbine casing 304 adjusts the clearance between the one or more turbine blades and the turbine casing 304. The thermoelectric element 306 may be in communication with a cooling system 307. In an example embodiment, the cooling system 307 may comprise a ventilation system 308. For example, when in a cooling mode, the thermoelectric element 306 may include an outer heat sink portion 111 as depicted in FIG. 1. The heat sink portion may dissipate heat transferred from the turbine casing 304 into the surrounding environment. The ventilation system 308 may direct the dissipated heat from the heat sink portion of the thermoelectric element 306 to a remote location where the heat may be recycled or discarded. In another embodiment, the cooling system 307 may include a cooling circuit 310. For example, the cooling system 308 may include a refrigerant cooling circuit in communication with the thermoelectric element 306. In some instances, the refrigerant cooling circuit may include a water cooling loop (open or closed). Any type or number of coolants may be used in the cooling circuit 310.

Figure 4:
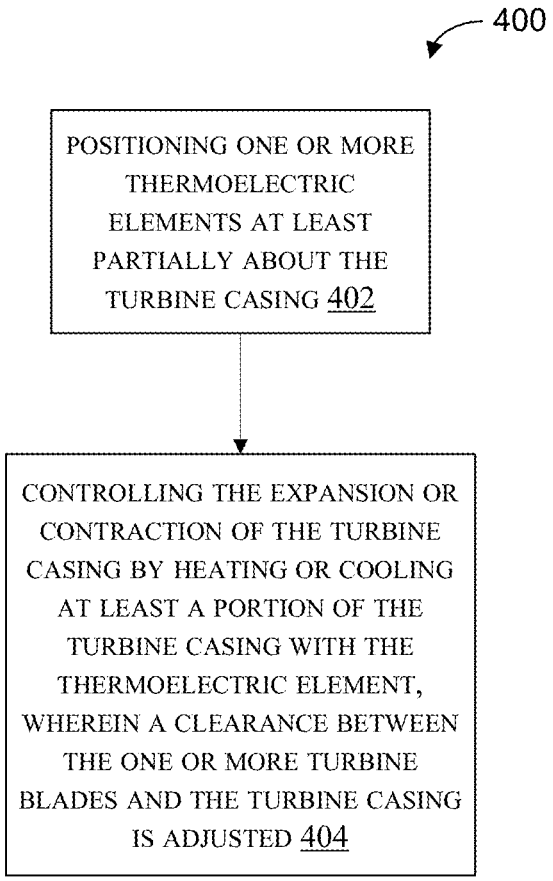
FIG. 4 is a flow diagram illustrating details of an example method for adjusting clearances in a turbine, according to an embodiment.

FIG. 4 illustrates an example flow diagram of a method 400 for adjusting clearances in a turbine, according to an embodiment of the invention. In one example, the illustrative controller device 112 of FIG. 1 and/or one or more modules of the illustrative controller device 112, alone or in combination, may perform the described operations of the method 400.

In this particular implementation, the method 400 may begin at block 402 of FIG. 4 in which the method 400 may include positioning one or more thermoelectric elements at least partially about the turbine casing. The one or more thermoelectric elements may be position inline with the one or more turbine blades or adjacent to the one or more turbine blades. Moreover, the one or more thermoelectric elements may by positioned about the entire circumference of the turbine casing or only a portion of the circumference of the turbine casing. The one or more thermoelectric elements may be positioned at any location and in any pattern on or about the turbine casing.

Block 402 is followed by block 404. At block 404, the method 400 may include controlling the expansion or contraction of the turbine casing by heating or cooling at least a portion of the turbine casing with the one or more thermoelectric elements, wherein a clearance between the one or more turbine blades and the turbine casing is adjusted. For example, in certain embodiments, the method 400 reduces the clearance between the one or more turbine blades and the turbine casing to increase efficiency during operation, i.e., the turbine casing may be cooled to contract it about the one or more turbine blades. In another embodiment, the method 400 increases the clearance between the one or more turbine blades and the turbine casing to increase efficiency during startup, i.e., the turbine casing may be heated to expand it about the one or more turbine blades to allow the one or more turbine blades to expand during startup.

Figure 5:
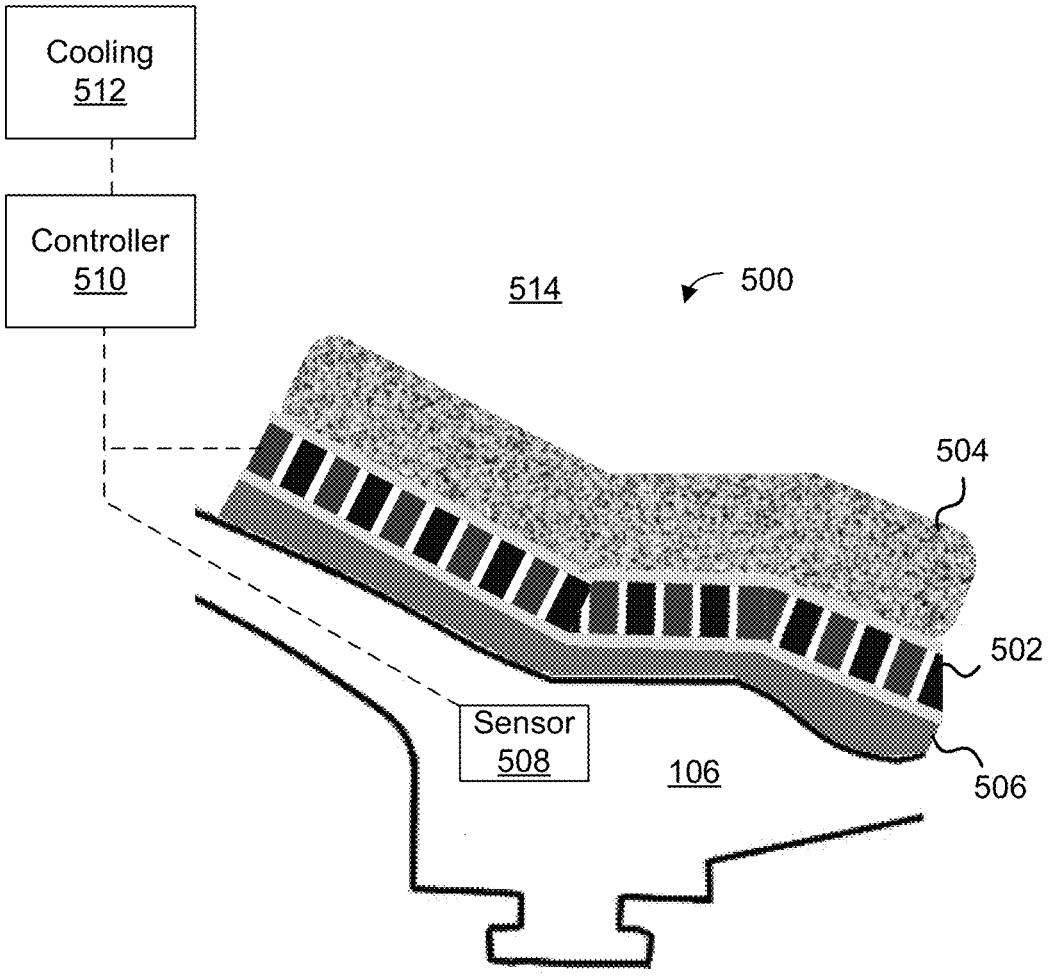
FIG. 5 is a schematic illustrating an example system for adjusting clearances in a turbine, according to an embodiment.

In an example embodiment, as depicted in FIG. 5, the thermoelectric element system 500 may include at least one Peltier element 502 or may include a component employing or otherwise implementing the Peltier effect. The heat transfer substrates 504 and 506 may be a cold sink or heat sink depending on the polarity of the voltage applied to the thermoelectric element system 500. In an example embodiment, the heat transfer substrate 504 may include a foam metal (such as, for example, copper foam, aluminum foam, or graphite foam) and the heat transfer substrate 506 may include a ceramic wafer (e.g., silicon or the like). In this embodiment, the ceramic wafer 506 may be disposed in abutting relation against the turbine casing 106. The thermoelectric element system 500 may be configured to control the expansion or contraction of the turbine casing 106 by controlling the heating or cooling of at least a portion of the turbine casing 106 via the at least one Peltier element 502, the metal foam heat sink 504, the ceramic wafer 506, and the cooling system 512 such that the clearance between the one or more turbine blades and the turbine casing 106 is adjusted due to the expansion or contraction of the turbine casing 106. The thermoelectric element system 500 can control the heating or cooling of the turbine casing 106 by controlling the voltage and polarity received by the at least one Peltier element 502. That is, the heating or cooling of the turbine casing 106 is dependent on the polarity of the voltage to the at least one Peltier element 502.

Still referring to FIG. 5, in an example embodiment, a controller 510 may be in communication with both the at least one Peltier element 502 and a cooling system 512. The controller 510 may be implemented using hardware, software, or a combination thereof for performing the functions described herein. By way of example, the controller 510 may be a processor, an ASIC, a comparator, a differential module, or other hardware means. Likewise, the controller 510 may include software or other computer-executable instructions that may be stored in a memory and executable by a processor or other processing means. In some instances, the controller 510 may be similar to the previously discussed controller device 112. The controller 510 may enable the at least one Peltier element 502 and the cooling system 512 to work in tandem to control the expansion or contraction of the turbine casing 106. For example, a temperature sensor 508 may monitor the temperature of the turbine casing 106. Depending on the temperature of the turbine casing 106, the controller 510 may adjusted (e.g., increase, decrease, and/or reverse) the voltage to the at least one Peltier element 502. Moreover, depending on the temperature of the turbine casing 106, the controller 510 may adjust the cooling system 512 to increase or decrease the amount of air (e.g., ambient air) directed to the metal foam 504 heat sink to increase or decrease heat transfer. In this manner, the controller 510 may concurrently control the at least one Peltier element 502 and the cooling system 512 to control the expansion or contraction of the turbine casing 106.

In an example embodiment, the thermoelectric element system 500 may be disposed within a turbine compartment 514. The turbine compartment 514 may wholly or partially enclose the thermoelectric element system 500 therein. The turbine compartment 514 may be under negative pressure so as to prevent the leakage of fluid therefrom. In this manner, the controller 510 may be in communication with the cooling system 512 to control the flow of fluid throughout the turbine compartment 514. For example, the controller 510 may be in communication with one or more flow valves or dampers of the cooling system 512. In some instances, the controller 510 may manipulate the one or more flow valves or dampers of the cooling system 512 to adjust the fluid flow directed towards the metal foam 504 heat sink to increase or decrease heat transfer. Accordingly, by way of the controller 510 the cooling system 512 may work in tandem with the at least one Peltier element 502 and to control the expansion or contraction of the turbine casing 106.

Illustrative systems and methods are described for adjusting clearances in a turbine. Some or all of these systems and methods may, but need not, be implemented at least partially by architectures such as those shown in FIG. 1 above.

Although embodiments have been described in language specific to structural features and/or methodological acts, it is to be understood that the disclosure is not necessarily limited to the specific features or acts described. Rather, the specific features and acts are disclosed as illustrative forms of implementing the embodiments.

That which is claimed:

1. A turbine system, comprising:
one or more turbine blades;
a turbine casing encompassing the one or more turbine blades;
a thermoelectric element disposed at least partially about the turbine casing;
a cooling system in communication with the thermoelectric element; and
a controller in communication with the cooling system and the thermoelectric element, the controller operable to control the expansion or contraction of the turbine casing by heating or cooling at least a portion of the turbine casing with the thermoelectric element and by adjusting the cooling system, wherein a clearance between the one or more turbine blades and the turbine casing is adjusted.

2. The system of claim 1, wherein the thermoelectric element comprises a Peltier element disposed between a cold sink and a heat sink, wherein a voltage is applied to the Peltier element to control heat transfer between the cold sink and the heat sink, and wherein the cold sink and the heat sink are dependent on the polarity of the applied voltage to the Peltier element.

3. The system of claim 2, wherein the cold sink and the heat sink comprise ceramic plates.

4. The system of claim 2, wherein the heat sink comprises metal foam.

5. The system of claim 4, wherein the metal foam is one or more of cooper foam, aluminum foam, or graphite foam.

6. The system of claim 1, wherein the cooling system comprises one or more of a ventilation system, a refrigerant cooling loop, an open system, or a closed system.

7. The system of claim 1, wherein the clearance between the one or more turbine blades and the turbine casing is reduced to increase efficiency during operation.

8. The system of claim 1, wherein the clearance between the one or more turbine blades and the turbine casing is increased to increase the efficiency and the speed of startup.

9. The system of claim 1, wherein the thermoelectric element is disposed circumferentially about at least a portion of the turbine casing in line with the one or more turbine blades.

10. A turbine system, comprising:
one or more turbine blades;
a turbine casing encompassing the one or more turbine blades;
at least one thermoelectric element disposed at least partially about the turbine casing;
a cooling system in communication with the thermoelectric element; and
a controller in communication with the cooling system and the at least one thermoelectric element, the controller comprising:
a computer processor; and
a memory in communication with the computer processor operable to store computer-executable instructions operable to:
control the expansion or contraction of the turbine casing by heating or cooling at least a portion of the turbine casing with the thermoelectric element and by adjusting the cooling system, wherein a clearance between the one or more turbine blades and the turbine casing is adjusted.

11. The system of claim 10, wherein the thermoelectric element comprises a Peltier element disposed between a cold sink and a heat sink, wherein a voltage is applied to the Peltier element to control heat transfer between the cold sink and the heat sink, and wherein the cold sink and the heat sink are dependent on the polarity of the applied voltage to the Peltier element.

12. The system of claim 10, wherein the cooling system comprises one or more of a ventilation system, a refrigerant cooling loop, an open system, or a closed system.

13. The system of claim 11, wherein the cold sink and the heat sink comprise ceramic plates.

14. The system of claim 11, wherein the heat sink comprises metal foam.

15. The system of claim 14, wherein the metal foam is one or more of cooper foam, aluminum foam, or graphite foam.

16. The system of claim 10, wherein the clearance between the one or more turbine blades and the turbine casing is reduced to increase efficiency during operation.

17. The system of claim 10, wherein the clearance between the one or more turbine blades and the turbine casing is increased to increase the efficiency and the speed of startup.

18. The system of claim 10, wherein the thermoelectric element is disposed circumferentially about at least a portion of the turbine casing in line with the one or more turbine blades.

19. A method for adjusting clearances in a turbine, the turbine comprising a turbine casing encompassing one or more turbine blades, the method comprising:

positioning one or more thermoelectric elements at least partially about the turbine casing;

providing a cooling system in communication with the one or more thermoelectric elements;

controlling a voltage to the one or more thermoelectric elements; and controlling a fluid flow of the cooling system.

20. The method of claim 19, further comprising adjusting a clearance between the one or more turbine blades and the turbine casing.

* * * * *